US012352033B2

(12) United States Patent
Geinitz et al.

(10) Patent No.: US 12,352,033 B2
(45) Date of Patent: Jul. 8, 2025

(54) WASTEWATER-LIFTING SYSTEM

(71) Applicant: KSB SE & Co. KGaA, Frankenthal (DE)

(72) Inventors: Juergen Geinitz, Frankenthal (DE); Michael Becker, Frankenthal (DE)

(73) Assignee: KSB SE & Co. KGaA, Frankenthal (DE)

( * ) Notice: Subject to any disclaimer, the term of this patent is extended or adjusted under 35 U.S.C. 154(b) by 723 days.

(21) Appl. No.: 17/053,642

(22) PCT Filed: May 7, 2019

(86) PCT No.: PCT/EP2019/061643
§ 371 (c)(1),
(2) Date: Nov. 6, 2020

(87) PCT Pub. No.: WO2019/215124
PCT Pub. Date: Nov. 14, 2019

(65) Prior Publication Data

US 2021/0071406 A1 Mar. 11, 2021

(30) Foreign Application Priority Data

May 9, 2018 (DE) ..... 10 2018 207 243.4

(51) Int. Cl.
*E03F 5/22* (2006.01)
*E03F 5/14* (2006.01)

(52) U.S. Cl.
CPC . *E03F 5/22* (2013.01); *E03F 5/14* (2013.01)

(58) Field of Classification Search
None
See application file for complete search history.

(56) References Cited

U.S. PATENT DOCUMENTS 4,582,605 A * 4/1986 Rea ..... B01D 29/35 210/450
2012/0090087 A1* 4/2012 Korupp ..... F04D 13/06 4/509

FOREIGN PATENT DOCUMENTS

DE 20 2008 011 273 U1 12/2008
DE 10 2010 038 137 A1 4/2012
EP 1 108 822 B1 10/2002
EP 2 581 508 A1 4/2013
(Continued)

OTHER PUBLICATIONS

"Machine Translation of WO 2010/025852", Becker et al., published 2010, 44 total pages. (Year: 2010).*
(Continued)

*Primary Examiner* — Jonathan M Peo
(74) *Attorney, Agent, or Firm* — Crowell & Moring LLP

(57) ABSTRACT

A wastewater-lifting system includes at least one bulky material-collection tank with at least one separating screen arranged in its interior for retaining bulky materials in wastewater loaded with bulky materials passing through the bulky material-collection tank. The system also includes at least one pump connected to the bulky material collection tank via at least one connection line. The separating screen may be removed from and reinserted into the bulky material collection tank predominantly vertically through a closable opening, guided by an inner guide in the bulky material collection tank.

13 Claims, 2 Drawing Sheets

(56) References Cited

FOREIGN PATENT DOCUMENTS

| | | |
|---|---|---|
| EP | 2 581 508 B1 | 3/2014 |
| EP | 2 966 231 A1 | 1/2016 |

OTHER PUBLICATIONS

International Search Report (PCT/ISA/210) issued in PCT Application No. PCT/EP2019/061643 dated Jul. 24, 2019 with English translation (four (4) pages).
German-language Written Opinion (PCT/ISA/237) issued in PCT Application No. PCT/EP2019/061643 dated Jul. 24, 2019 (five (5) pages).
German-language Search Report issued in German Application No. 10 2018 207 243.4 dated Feb. 14, 2019 with partial English translation (14 pages).

* cited by examiner

WASTEWATER-LIFTING SYSTEM

CROSS REFERENCE TO RELATED APPLICATIONS

This application is a national phase of PCT International Application No. PCT/EP2019/061643, filed May 7, 2019, which published as WO 2019/215124 on Nov. 14, 2019, which claims priority under 35 U.S.C. § 119 from German Patent Application No. 10 2018 207 243.4, filed May 9, 2018, the entire disclosures of which are herein expressly incorporated by reference.

BACKGROUND AND SUMMARY OF THE INVENTION

The invention relates to a wastewater-lifting system having at least one bulky material-collecting tank which has at least one separating screen arranged in its interior for wastewater laden with bulky materials that is to be guided therethrough, and having at least one pump which is arranged after the bulky material-collecting tank and which is connected to the bulky material-collecting tank via at least one connecting line, wherein the separating screen, by way of a closable opening in the bulky material-collecting tank, is configured to be selectively removable from said tank and re-insertable into it.

Wastewater-lifting systems normally serve for lifting to a specific level wastewater collected at the end of a wastewater storage space. In order to keep coarse solids or solids which are situated in the wastewater away from the at least one pump, the bulky material-collecting tank is provided. Here, the solids are separated from the delivery medium or the wastewater before the delivery medium freed of the solids enters the pump. The separating screen arranged in the interior of the bulky material-collecting tank ensures the separation of the solids from the delivery medium.

Ideally, the bulky materials remain in the bulky material-collecting tank during this process, so that solely wastewater pre-cleaned in this manner is transferred into a liquid-collecting tank connected after the bulky material-collecting tank. In this case, the pre-cleaned wastewater flows through the pump arranged after the bulky material-collecting tank and subsequently enters the liquid-collecting tank. The basic functioning of such a wastewater-lifting system is described for example in EP 1 108 822 B1.

EP 2 581 508 B1 concerns a comparable wastewater-lifting system, which is equipped with a filter apparatus outside the housing for the liquid-collecting tank or outside said liquid-collecting tank. The filter apparatus has a filter box having a closable opening that is placed before the pump. In detail, the filter apparatus has a screen unit which is designed to be exchangeable and which is formed by a multiplicity of strips formed in the manner of a comb with gaps and teeth. Although this allows the screen unit to be removed, and for example cleaned or exchanged, in principle, the metal strips used at this position are relatively fragile. Although said metal strips make it possible for the filtering properties of the screen unit to be altered, damage to the strips in question, both during operation and during installation and removal, is possible and cannot be ruled out.

In the generic prior art according to DE 20 2008 011 273 U1, the bulky material-collecting tank there is equipped with a shut-off/screen device as a structural unit composed of a shut-off flap and a screen which also works or can work as a separating screen. The shut-off/screen device forms, together with a terminating flange of the bulky material-collecting tank, a structural unit and can be removed from the bulky material-collecting tank in question and re-inserted into it. Although such a procedure has proven successful in principle, the installation and removal of the structural unit mentioned is not without problems, because for this purpose the terminating flange has to be coupled and screwed to the bulky material-collecting tank from the side. In view of the considerable weight of 50 kg and more that is often observed at this position, problems can arise here, flange holes especially having to be additionally placed in an overlapping manner in each case.

Finally, the prior art discloses a screen apparatus for a wastewater-lifting system, as is described in EP 2 966 231 A1. The screen apparatus and the bulky material-collecting tank are in this case configured altogether outside a collecting tank or liquid-collecting tank and thus so as to be freely accessible. The screen apparatus comprises at least one module, which has an outer frame. Within the outer frame, there extend from the circumference thereof toward the center of the outer frame multiple alternately long and short pins which are arranged with a spacing to one another. The pins run in an inclined manner in the direction of the delivery flow generated during the emptying of the collecting tank, so as to deviate from the perpendicular direction of the delivery flow.

Moreover, the screen apparatus forms an independent component, which is connected detachably to the wastewater-lifting system. The installation and removal of the screen apparatus is realized here from the side again, that is to say for example from the right, into an associated housing. With a high weight of the screen apparatus, this is a disadvantage, comparable to the prior art according to DE 20 2008 011 273 U1 already described above.

The invention is based on the technical problem of further developing a wastewater-lifting system of said type such that the separating screen is easily accessible with little effort.

To solve said technical problem, the invention proposes, in the case of a generic wastewater-lifting system, that the bulky material-collecting tank is configured with an inner-side guide, in particular a linear guide, for the separating screen, which is able to be plugged into said inner-side guide and pulled out again, wherein both the plugging process and the pulling process for the separating screen are realized predominantly vertically. According to an advantageous configuration, the separating screen is arranged on a slide-in frame, which interacts with the guide. Consequently, via the slide-in frame, the separating screen can, without any problems, be plugged into the inner-side guide, in particular linear guide, provided in the bulky material-collecting tank, and pulled out again, specifically predominantly vertically.

In this way, simple installation and removal of the separating screen is provided first of all. This applies specifically if the plugging process and pulling process for the separating screen or for the slide-in frame bearing the separating screen are realized predominantly vertically, that is to say in the direction of gravity, or in the direction opposite thereto. In this way, in particular during the installation of the separating screen, use can additionally be made in a simple and unproblematic manner of gravitational forces, because the separating screen, including the slide-in frame, is plugged in the direction of gravity into the inner-side guide provided on the inner side in the bulky material-collecting tank.

Although it is necessary to work against gravity in the case of the separating screen and the associated slide-in frame being pulled out, the pulling process, just like the plugging process, is realized by way of guidance with the aid of the guide, with the result that jamming of or else damage to the separating screen is at any rate avoided during both processes, by contrast to the prior art, for example according to EP 2 581 508 B1.

In addition, the guide or linear guide renders unnecessary the alignment of any flanges or fastening openings with respect to one another, as is required in further prior art according to DE 20 2008 011 273 U1. A relatively complicated assembly is also observed in the context of EP 2 966 231 A1. All of this leads to the installation and removal of the separating screen, by contrast, in the present invention, being realized and also realizable in a particularly simple, functional and quick manner.

Additionally contributing to this is the fact that, during installation and removal, work is realized predominantly in the direction of gravity, or in the direction opposite thereto, with the result that proven lifting equipment can be used as required without diversions of force or the like being necessary. The main advantages are considered to consist therein.

The advantages and effects of the invention already described above are already evident if the bulky material-collecting tank is basically arranged in the interior of the liquid-collecting tank, as is predominantly illustrated and described in EP 2 581 508 B1. As a rule, however, the bulky material-collecting tank (as well as the pump) is arranged outside the liquid-collecting tank, in a manner comparable to that described and emphasized in EP 2 966 231 A1. By contrast, the invention makes use of an inner-side linear guide in the bulky material-collecting tank that extends vertically or predominantly in the direction of gravity, whereas in the previously mentioned and known teaching, although an exchange is possible, it is such that the screen apparatus there is again plugged in and pulled out from the side. In EP 2 581 508 B1, although a predominantly vertical movement of the separating screen is observed, it is unguided, and so, during this process, damage to the inserted strips of the filter is possible.

According to an advantageous configuration, the slide-in frame, bearing the separating screen, and the guide are of U-shaped form in a front view. In fact, the configuration is such that the respective U shape extends with the associated U-limbs predominantly vertically or in the direction of gravity.

In order to facilitate the installation even further, the separating screen, the guide and the slide-in frame are generally arranged in a box housing part of an otherwise tubular housing of the bulky material-collecting tank. The box housing part is advantageously provided with the top-side opening for the separating screen. Here, it has proven to be particularly expedient for the opening to be rectangular. This is because, altogether, this allows an associated rectangular closure flange to be used too. It is even possible for said closure flange to be equipped with a quick-action closure means.

At any rate, the generally predominantly tubular housing of the bulky material-collecting tank is, as a rule, of box-like configuration at least in the region of the separating screen, and consequently of the guide and of the slide-in frame. This is because, in said region, the box housing part of the otherwise tubular housing of the bulky material-collecting tank is realized.

As a rule, the box-like configuration or the box housing part has a base matched to the tubular shape and has two side walls extending parallel to one another, so that, in this way, a U-shaped cross section of the box housing part with the top-side closure flange is obtained in an unconstrained manner. Accordingly, the opening of the box housing part is rectangular. The closure flange also has an associated rectangular shape, which closes off the opening. The closure flange may however also be of circular or oval form.

According to a further advantageous configuration of particular importance, the slide-in frame is connected to the closure flange. In this case, during an installation of the separating screen and an associated plugging process of the slide-in frame into the inner-side guide, not only is the separating screen directly aligned, but also the closure flange connected to the slide-in frame is aligned, with respect to the opening. Consequently, the installation and removal of the separating screen are possible in a particularly simple manner with little effort, and for this reason any maintenance and cleaning tasks can be carried out particularly quickly and easily.

Generally, the slide-in frame bears not only the separating screen, but additionally also a shut-off flap. The shut-off flap is generally connected to the slide-in frame via a joint. With the aid of the shut-off flap, an opening in the slide-in frame can be closed off at least to the extent that a wastewater flow can pass through only the separating screen. In fact, the separating screen is composed advantageously and substantially of multiple webs which are arranged at the edge of said opening in the slide-in frame and which are spaced apart from one another. The configuration may in this case be selected to be comparable with that in DE 20 2008 011 273 U1, the latter having already been referred to above.

Consequently, provision is made of a wastewater-lifting system which allows simple maintenance and cleaning of the separating screen, specifically without there being a risk of damage to the separating screen during installation and removal. Moreover, installation and removal are possible in a particularly simple and targeted manner because, for this purpose, merely a guided plugging process as well as pulling process is necessary within the context of the invention. In this way, any jamming or damage is ruled out. Installation and removal are moreover significantly facilitated. The main advantages are considered to consist therein.

The invention will be explained in more detail below on the basis of a drawing which illustrates merely an exemplary embodiment, in the figures:

DETAILED DESCRIPTION

Figure 1:
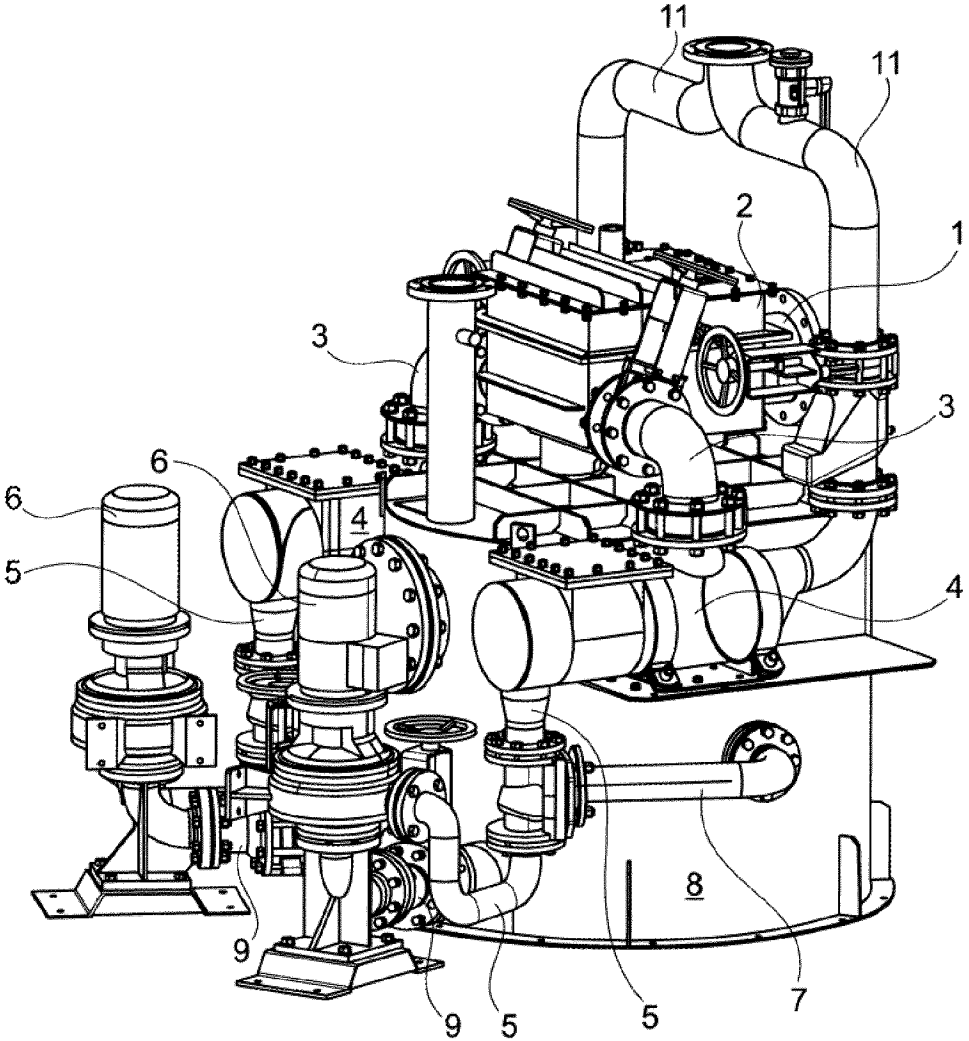
FIG. 1 shows a wastewater-lifting system according to an embodiment of the present invention in a perspective overview.

The figures illustrate a wastewater-lifting system. This first of all has an inflow 1 for wastewater, which, via an inflow distributor 2, transfers the wastewater via a feed line 3 in each case into two bulky material-collecting tanks 4 in the exemplary embodiment. In the context of the exemplary embodiment, the wastewater-lifting system is of symmetrical configuration and has two bulky material-collecting tanks 4 and additionally also two discharge lines or connecting lines 5, via which the wastewater pre-cleaned with the aid of the bulky material-collecting tanks 4 passes into an associated pump 6.

The bulky material-collecting tank 4 or the two bulky material-collecting tanks 4 in each case ensure that the wastewater flowing in altogether via the inflow 1 and the inflow distributor 2 and laden with solids is freed of the bulky materials or solids, which remain in the associated bulky material-collecting tank 4. The wastewater pre-cleaned in this manner then passes into the pump 6 via the discharge line 5, or directly into a liquid-collecting tank 8 via a bypass 7. The pre-cleaned wastewater flowing through the respective pump 6 passes, via a discharge line 9, likewise into the liquid-collecting tank 8. The intake of the wastewater corresponds to this.

During a pumping or lifting process, the pre-cleaned wastewater is then sucked in from the liquid-collecting tank 8 via the discharge line 9, in each case by the pump 6, and forced through the discharge line or connecting line 5 into the bulky material-collecting tank 4. Here, the pre-cleaned wastewater entrains the solids retained in the bulky material-collecting tank 4 and transfers the wastewater via a pressure line 11 to a further system, or generally for further treatment. In this way, during the subsequent pumping process, the bulky materials are released from the bulky material-collecting tank 4 and flushed practically without resistance into the pressure line 11. For the following considerations and details of the invention, the configuration and function of the bulky material-collecting tank 4 in particular is of importance.

Figure 2:
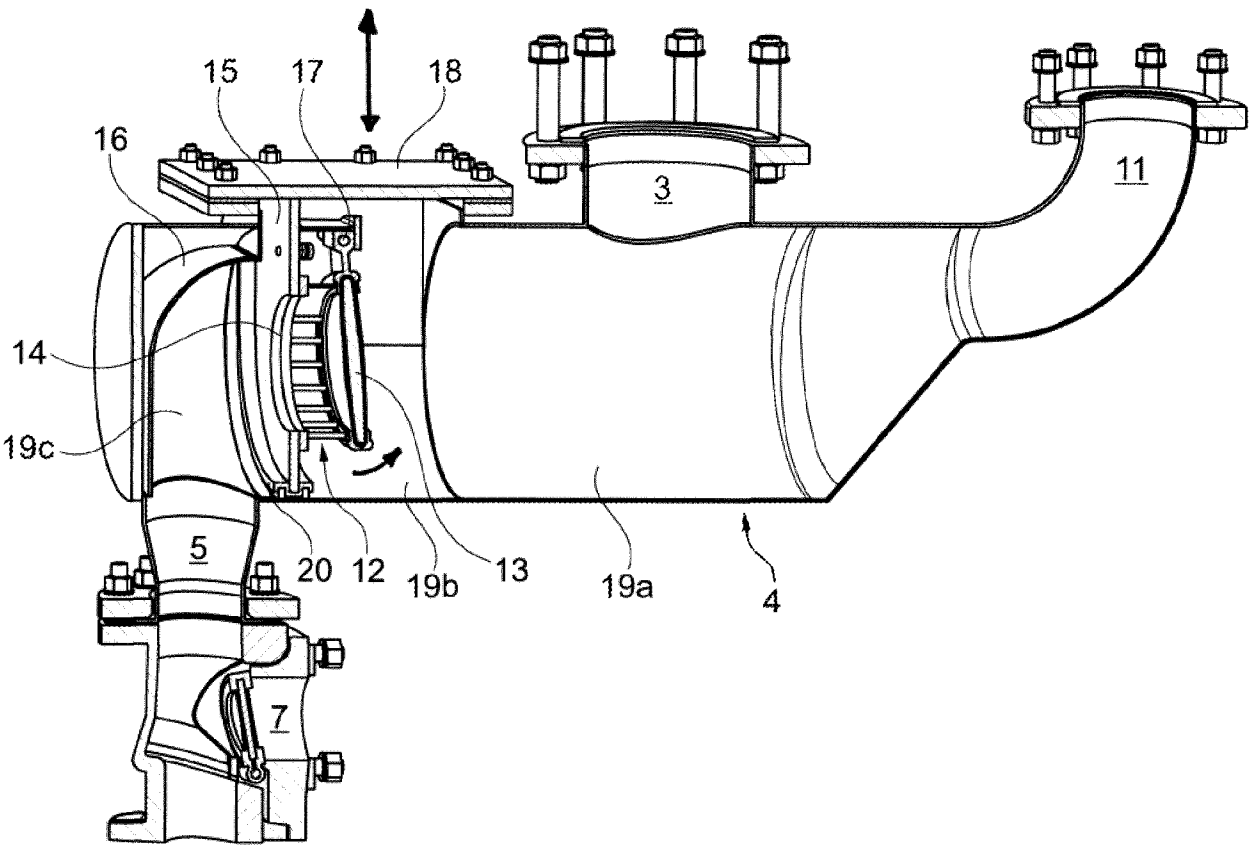
FIG. 2 shows a schematic longitudinal section through the bulky material-collecting tank serving as a constituent part of the wastewater-lifting system according to FIG. 1.

FIG. 2 then illustrates a longitudinal section of the bulky material-collecting tank 4. First of all, corresponding connection flanges for the feed line 3, on the one hand, and for the pressure line 11, on the other hand, can be seen. Moreover, part of the bypass or the bypass line 7 can be seen. This applies to the connecting line 5 too.

What is decisive is the fact that the bulky material-collecting tank 4 is equipped first of all with a separating screen 12 arranged in its interior. The wastewater laden with bulky materials is guided through the separating screen 12. In fact, the wastewater flows from the inflow 1 via the inflow distributor 2 and the feed line 3 and finally into the bulky material-collecting tank 4. From there, the wastewater flows through the separating screen 12. During this process, the separating screen 12 ensures that the solids are retained in the bulky material-collecting tank 4.

For this purpose, the separating screen 12, according to the exemplary embodiment, is assigned a shut-off flap 13. The shut-off flap 13 ensures that an opening 14 in a slide-in frame 15 is closed off and that, during the intake of wastewater, the wastewater laden with the bulky materials enters, as pre-cleaned wastewater, only through the separating screen 12 into the associated connecting line or discharge line 5 or the bypass or the bypass line 7, and from there passes into the liquid-collecting tank 8. Here, the wastewater is diverted with the aid of a diverter or a diversion plate 16. This is because the bulky material-collecting tank 4 extends predominantly horizontally, whereas the pre-cleaned wastewater is diverted via the discharge line 5 vertically downward according to the exemplary embodiment in order, from there, to be able to enter the pump 6 or the bypass 7. Of course, this is merely an example and is by no means restrictive.

The shut-off flap 13 is connected to the slide-in frame 15 via a joint 17. It can moreover also be seen from the illustration in FIG. 2 that the slide-in frame 15 is, for its part, connected to a closure flange 18, which closes off an opening in a box housing part 19*b*. In fact, the housing 19*a*, 19*b*, 19*c* of the bulky material-collecting tank 4 is composed of a tubular housing part 19*a* and substantially the box housing part 19*b*. The separating screen 12 and the slide-in frame 15 and also an inner-side guide 20, to be described in more detail below, for the separating screen 12, which is able to be plugged into said guide and pulled out again, are realized in the box housing part 19*b*. Finally, the housing 19*a*, 19*b* and 19*c* also comprises a diversion housing part 19*c* in which the diverter or the diversion plate 16 is arranged. While the diversion housing part 19*c* and the tubular housing 19*a* are of predominantly cylindrical form, the box housing part 19*b* not only has the top-side opening closed off with the aid of the closure flange 18, but is altogether of U-shaped form in cross section. In fact, the box housing part 19*b* has an arcuate base and two U-limbs which extend predominantly parallel to one another and which define the top-side opening with the rectangular closure flange 18 provided there.

According to the invention, the separating screen 12 provided in the bulky material-collecting tank 4 can, by way of the opening, which is selectively closable and openable with the aid of the closure flange 18, as a consequence thereof be removed from the bulky material-collecting tank 4, and re-inserted into it, according to selection. For this purpose, the bulky material-collecting tank 4 is equipped with the inner-side guide 20 already described above. It can be seen from FIG. 2 that the inner-side guide 20 is of U-shaped form in a front view, such that the slide-in frame 15 is held correctly between the two U-limbs in the plugged state.

Furthermore, the slide-in frame 15 and the guide 20 are each of U-shaped form in a front view. Here, the respective U shape follows the U-shaped form of the box housing part 19*b* of the housing 19*a*, 19*b*, 19*c* of the bulky material-collecting tank 4. In this way, the slide-in frame 15, with the separating screen 12 arranged thereon and, according to the exemplary embodiment, the shut-off flap 13, can be plugged into the inner-side guide 20 and pulled out of the guide 20 again. The corresponding plugging process, as well as a pulling process, of the separating screen 12 is in this case realized predominantly vertically or in the direction of gravity, and according to the double-headed arrow illustrated in FIG. 2. That is to say, the plugging process as well as the pulling process for the separating screen 12 into and out of the inner-side guide 20, indicated by the double-headed arrow, is carried out perpendicularly to the horizontal extent of the bulky material-collecting tank 4.

As already explained, the separating screen 12, as well as the optional shut-off flap 13, is arranged on the slide-in frame 15, which interacts with the guide 20 on the inner side of the bulky material-collecting tank 4. In this way, the slide-in frame 15, the separating screen 12 and finally the shut-off flap 13 are plugged into the guide 20, and pulled out of the guide 20 again, in one operation together with the closure flange 18. Moreover, the separating screen 12, the guide 20 and the slide-in frame 15, as well as the shut-off flap 13, are arranged in the box housing part 19*b* of the otherwise tubular housing 19*a*, 19*b*, 19*c* of the bulky material-collecting tank 4. The rectangular closure flange 18 already discussed, which may also be equipped with a quick-action closure means, ensures the closure of the top-side opening of the box housing part 19*b*. The closure flange may also be of circular or oval form.

The separating screen 12 is composed substantially of multiple webs which are arranged at the edge of the opening 14 in the slide-in frame 15 and which are spaced apart from one another. During the intake via the feed line 3 of the wastewater laden with solids (illustrated in FIG. 2), the shut-off flap 13 is, as illustrated, closed and bears at the head side against the webs in question, which form the separating screen 12. Consequently, the wastewater flows via the separating screen 12 into the discharge line 5, and the solids or bulky materials are retained by the separating screen 12 during this process. The wastewater pre-cleaned in this way subsequently passes into the liquid-collecting tank 8, as has been described already in the introduction.

If a wastewater-lifting process, and thus a pumping process realized by the pump 6, then occurs, then the pre-cleaned wastewater sucked in from the liquid-collecting tank 8 with the aid of the pump 6 in question is forced into the bulky material-collecting tank 4 via the connecting line 5, with the result that the shut-off flap 13 is consequently lifted out of its position of abutment against the separating screen 12, as indicated by an arrow in FIG. 2. In this way, the solids previously retained with the aid of the separating screen 12 are detached from the latter and transported away via the pressure line 11. A valve or a shut-off flap provided in the feed line 3 ensures in this case that the wastewater in question cannot pass into the inflow distributor 2.

What is claimed is:

1. A wastewater-lifting system, comprising:

at least one bulky material-collecting tank having at least one separating screen arranged therein configured to separate bulky material from wastewater laden with the bulky material; at least one pump configured to pump or lift the wastewater is arranged in a downstream direction from the at least one bulky material-collecting tank, wherein the at least one pump is connected to the at least one bulky material-collecting tank via at least one connecting line, the at least one separating screen and a closable opening are configured to allow wastewater flow from the at least one pump upstream into the at least one bulky material-collecting tank, the at least one separating screen and the closable opening are removable as a unit from the at least one bulky material-collecting tank, the at least one bulky material-collecting tank includes an inner-side guide extending circumferentially around an inner wall of a box housing portion, the inner-side guide being configured to guide removal and insertion of the at least one separating screen and the closable opening in a predominately vertical direction.

2. The wastewater-lifting system as claimed in claim 1, wherein wherein the shut-off flap is plugged into and pulled out of the inner-side guide.

3. The wastewater-lifting system as claimed in claim 2, wherein the at least one separating screen is arranged on a slide-in frame, which is slidable into and out of the box housing portion and interacts with the inner-side guide.

4. The wastewater-lifting system as claimed in claim 3, wherein the slide-in frame and the inner-side guide are each formed in a complementary U-shape in a frontal view.

5. The wastewater-lifting system as claimed in claim 3, wherein the at least one separating screen is arranged on the slide-in frame configured to cooperate with the inner-side guide during the removal and insertion.

6. The wastewater-lifting system as claimed in claim 3, wherein the at least one separating screen, the inner-side guide and the slide-in frame are arranged in the box housing portion of an otherwise tubular housing of the bulky material-collecting tank.

7. The wastewater-lifting system as claimed in claim 3, wherein the box housing portion has a top-side opening configured to receive the at least one separating screen, the inner-side guide and the slide-in frame.

8. The wastewater-lifting system as claimed in claim 7, wherein the top-side opening is configured to be closed off by a closure flange.

9. The wastewater-lifting system as claimed in claim 8, wherein the top-side opening and the closure flange are rectangular.

10. The wastewater-lifting system as claimed in claim 8, wherein the slide-in frame is connected to the closure flange.

11. The wastewater-lifting system as claimed in claim 10, wherein the closable opening includes a shut-off flap, the slide-in frame supports the at least one separating screen and the shut-off flap.

12. The wastewater-lifting system as claimed in claim 11, wherein the shut-off flap is connected to the slide-in frame via a joint.

13. The wastewater-lifting system as claimed in claim 12, wherein the at least one separating screen includes multiple webs arranged at an edge of an aperture in the slide-in frame, and the multiple webs are spaced apart from one another.

* * * * *